US005151167A

United States Patent [19]

Truong et al.

[11] Patent Number: 5,151,167

[45] Date of Patent: Sep. 29, 1992

[54] COINS COATED WITH NICKEL, COPPER AND NICKEL AND PROCESS FOR MAKING SUCH COINS

[75] Inventors: Hieu C. Truong, Orleans; Maria Dilay, Ottawa, both of Canada

[73] Assignee: Royal Canadian Mint, Ottawa, Canada

[21] Appl. No.: 801,636

[22] Filed: Dec. 4, 1991

Related U.S. Application Data

[63] Continuation of Ser. No. 568,739, Aug. 17, 1990, abandoned.

[30] Foreign Application Priority Data

Jun. 21, 1990 [CA] Canada ..... 2019568

[51] Int. Cl.[5] ..... C25D 5/12; C25D 5/18

[52] U.S. Cl. ..... 205/102; 72/46; 205/149; 205/181; 205/217; 205/222; 205/227

[58] Field of Search ..... 205/102, 149, 181, 217, 205/222, 227, 228; 72/46

[56] References Cited

U.S. PATENT DOCUMENTS

| | | | |
|---|---|---|---|
| 3,594,288 | 7/1971 | Reinert | 204/34 |
| 3,689,380 | 9/1972 | Clauss | 204/38 B |
| 4,089,753 | 5/1978 | McMullen et al. | 204/23 |
| 4,189,356 | 2/1980 | Merony | 204/25 |
| 4,247,374 | 1/1981 | Ruscoe et al. | 204/23 |
| 4,279,968 | 7/1981 | Ruscoe et al. | 428/677 |
| 4,418,125 | 11/1983 | Henricks | 428/639 |
| 4,475,991 | 10/1984 | Shabata | 204/15 |
| 4,666,796 | 5/1987 | Levine | 428/670 |

FOREIGN PATENT DOCUMENTS

| | | | |
|---|---|---|---|
| 360046 | 8/1936 | Canada . | |
| 964223 | 3/1975 | Canada | 204/25 |
| 1105210 | 7/1981 | Canada | 13/16 |
| 1198073 | 12/1985 | Canada | 204/17 |
| 0163419 | 5/1988 | European Pat. Off. . | |
| 523322 | 11/1940 | United Kingdom . | |
| 897279 | 5/1962 | United Kingdom . | |

OTHER PUBLICATIONS

A. Kenneth Graham, Electroplating Engineering Handbook, second edition, Reinhold Publishing Corp., New York, 1962, pp. 670-671.

Frederick A. Lowenheim, Electroplating, McGraw-Hill Book Co., New York, 1978, pp. 194-202.

*Primary Examiner*—John Niebling

*Assistant Examiner*—William T. Leader

*Attorney, Agent, or Firm*—Cushman, Darby & Cushman

[57] ABSTRACT

This invention overcomes problems such as pinholes and blisters in making plated coin blanks and similar articles. A ferrous metal blank is electroplated with a strike of nickel, following which a coating of copper is applied at an initial low current density followed by full current density to minimize bridging. The low current density may be about 1/6 to ¼ of the full current density. Preferably an outer layer of nickel is applied, also at an initial low current density, followed by full current density. Annealing before or after application of the final layer of nickel is advisable. This invention also relates to the resulting coin blank and coins.

14 Claims, 1 Drawing Sheet

COINS COATED WITH NICKEL, COPPER AND NICKEL AND PROCESS FOR MAKING SUCH COINS

Figure 1:
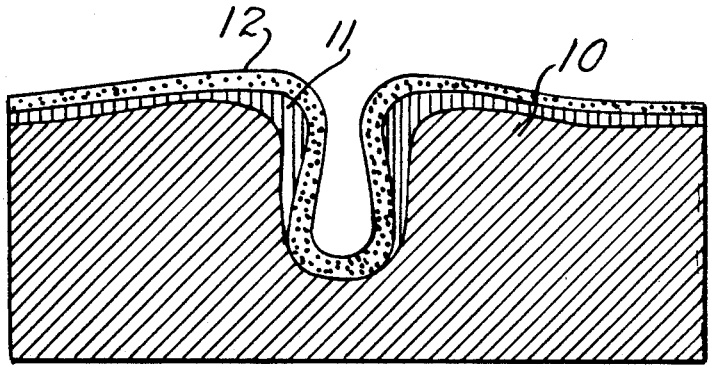

This is a continuation of application Ser. No. 07/568,739, filed on Aug. 17, 1990, which was abandoned upon the filing hereof.

This invention is concerned with a method of making plated coin blanks and coins and similar articles such as medals. This invention is particularly concerned with nickel plated coin blanks and coins but may also be utilized to provide coins with a copper exterior.

Coins have been made from nickel plated on steel, but there is a tendency for rust spots to develop at pinhole locations where the plating does not totally cover the steel. Pinholes may occur in the plated layer as a result of surface phenomenon in the layer of nickel plating or may be the result of micropores at the surface of the steel.

During coining, the dies stretch the metal, particularly at the edge of the coin. Pinholes may extend to expose the steel as a result of this stretching. Cracks in the plating may also develop at the edges. Either of these occurrences will result in rust.

If there are pores in the plating and these are bridged during the electroplating process, the entrapped air may blow during the coining procedure causing blisters. This is a severe problem in coinage. Some manufacturers of coins have been known to pound the metal with small steel balls to try to minimize the problem of blisters and pinholes.

Another problem that develops during coining is known as 'starbursts'. During nickel plating the layer of nickel would build up peaks. During coining these spots will be cut off or flattened. This abrasive action would score the surface of the dies.

The object of this invention is to provide plated coin blanks and coins and a method of making such coin blanks and coins in which there are significant improvements in overcoming such problems as compared with present practice.

In the preferred practice of this invention we employ a multi-layer plating of steel with nickel-copper - nickel. There is less tendency for iron to be oxidized as it is protected by a layer of copper which has a positive potential in the EMF Series of +0.34 as compared with iron at −0.44 and nickel at −0.25. Also with a three layer system any micropore in one layer is unlikely to penetrate all three layers to expose the iron. If there is a surface micropore in the steel it will probably be covered by at least one of the layers. Some of the advantages of this invention can however be achieved by plating with nickel - copper to leave a copper exterior surface.

Electroplating with multilayers including copper and nickel has been known for purposes such as the electroplating of car bumpers. For example, U.S. Pat. No. 4,418,125 dated Nov. 29, 1983 describes steel coated with successive layers of nickel, cadmium, copper, nickel and chromium. Also Canadian Patent 369,046 dated Aug. 15, 1936 discloses a layer of nickel, then copper, then nickel so that the copper will give a visual indication of improper buffing.

There are problems accompanying the use of successive layers of nickel, copper and nickel in coins, which are not encountered, at least to the same extent, in making car bumpers. One of the most severe problems is that of blistering. As previously noted, this results from bridging over gas trapped in micropores followed by the application of pressure during coining. This bridging is particularly likely to occur with multilayer plating. Another problem is that of severe mechanical deformation and stretching during minting.

It is therefore a further object of this invention to provide a method for applying a multilayer plating which minimizes problems during coining.

This invention preferably provides a process for making a coin blank, coin or like article comprising:

a) cleaning a ferrous metal blank so that it is essentially free of oxides, oils or dirt;
b) electroplating said blank with a strike of nickel;
c) electroplating the strike of nickel with a coating of copper at an initial low current density, followed by electroplating the copper at full current density to minimize or avoid bridging of micropores;
d) preferably electroplating the copper with an outer layer of nickel at an initial low current density followed by electroplating the nickel at full current density to minimize or avoid bridging of micropores;
e) annealing the copper at a moderate temperature to increase malleability without causing blistering, either before or after application of the outer layer of nickel;
f) where the final product is a coin, pressing in a coining operation without the development of pores or cracks which would expose the ferrous metal.

This invention also includes coins and coin blanks resulting from this process.

Figure 1A:
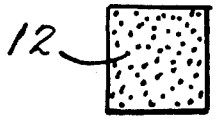
Figure 1B:
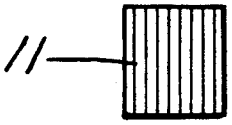
Figure 1C:
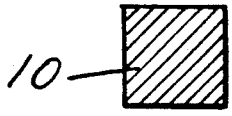
Figure 2A:
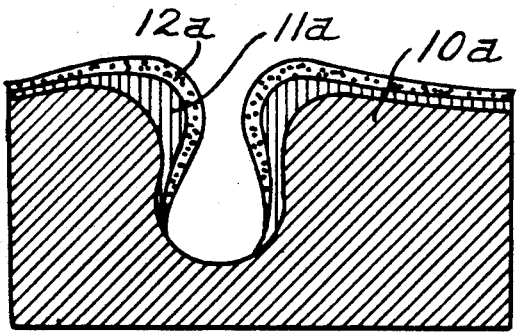
Figure 2B:
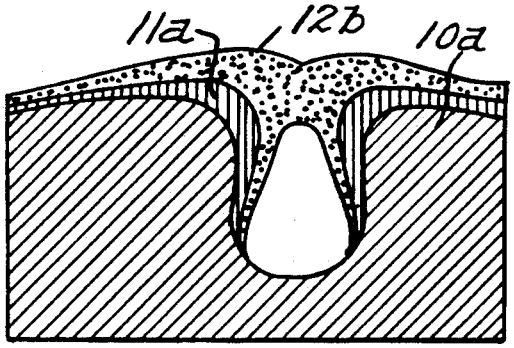
Figure 2C:
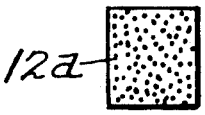
Figure 2D:
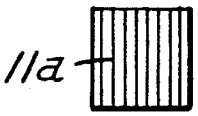
Figure 2E:
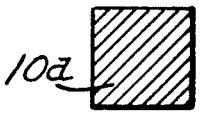

In the drawings which illustrate a preferred embodiment of this invention;

FIG. 1 is a diagrammatic cross sectional view showing the deposit of a molecular layer of copper at low current density at the beginning of copper plating followed by plating at full current density; Fig. 1a illustrates the copper molecular layer 12; Fig. 1b illustrates the nickel strike 11 and Fig. 1c illustrates the steel core 10;

Figs. 2a and 2b are comparative cross-sectional views showing what may occur where copper is plated using a high current density from the start. Figs. 2c–2e are views similar to Figures 1a–1c.

We will now discuss the preferred practice in accordance with this invention in more detail.

The manufacture of coins in accordance with this invention commences with the cleaning of the steel or other ferrous metal blanks. These blanks are tokens in the form of discs having a diameter about twelve times their thickness.

Round blanks, or blanks of other geometric shapes, are cut from low carbon steel strip, with a carbon content below 0.02%, preferably at a level of 0.01% or less. They are then rimmed to obtain a smooth edge on the perimeter to eliminate denting and scratching while being plated and to help in forming a good coin edge flat upon minting with a reasonable tonnage.

The blanks are then annealed at 700°–900° C. in an oxygen free atmosphere and cooled slowly. Under slow cooling conditions, we are able to get a hardness of approximately 40 R30T. (This and similar references below indicates the Rockwell Superficial Scale using a 30 kg 1/16" ball). Without annealing it is found that the steel surface is oxidized easily upon pickling. The annealing under a hydrogen atmosphere helps remove the steel surface oxides.

The blanks are then loaded into a rotary plating barrel. The number of blanks used in this development may vary from 90 to 200, depending on their sizes. All figures given in the process description refer to an average load size of 100 blanks.

Normal cleaning practices prior to electroplating are used to prepare the blanks for plating. This may include any or all of the following steps: washing the blanks with special alkaline detergents, rinsing, solvent degreasing, electrolytic cleaning, and rinsing in deionized water.

The traditional method is to clean with a basic solution followed by an acid pickling which is supposed to improve the adhesion to the nickel or other coating. We have found it to be advantageous to reverse this procedure. We first use an acid pickling followed immediately by a quick wash with a dilute sodium hydroxide solution to buffer the acid. We have found that with the traditional cleaning procedure, there is some oxidation even if only a short time elapses before electroplating. We find that this oxidation is significantly decreased by reversing the order.

The pickling solution may be a 10% hydrochloric acid solution for 30 seconds at 55° C. The solution is applied in the rotary barrel previously referred to, which is rotated at a rate of 10 rpm during cleaning, pickling and rinsing. The rinse is with a mild basic wash to neutralize the acid. A suitable rinse solution contains sufficient sodium hydroxide to provide a solution of a pH of 9.0.

The second step is to apply a nickel strike to deposit a coating of nickel which is about 0.8 to 1.2% of the final weight of the coin. The nickel used to apply the nickel strike should be low sulphur nickel; that is to say, dull nickel and not what is known as bright nickel. Suitable conditions for applying the nickel strike are described below in Example I.

EXAMPLE I

The blanks are flash coated with a nickel strike. A Watts nickel sulfate bath is preferred since it is less corrosive to steel than the Woods nickel strike bath. A suitable composition of the nickel strike bath and the operating parameters are given in Table 1.

TABLE 1

| | |
|---|---|
| Nickel sulfate | 300 g/l |
| Nickel chloride | 90 g/l |
| Boric acid | 45 g/l |
| pH = 1-2 | |
| Temperature - 60° C. | |
| Current density - 8 ASF | |

The wetting agent used was a commercial product, Y-17, supplied by M & T. Chemicals. The quantity used was 0.1% by volume. This plating step produces a very porous deposit.

Typically, for a load of 5 cents blank size, the time for the 1% nickel strike is approximately 30 minutes and the dull nickel deposit is about 0.005 mm thick (see Table 5).

The barrel and plated pieces are then rinsed in a cold drag-out water tank. It is further rinsed with hot water and finally, it is rinsed with cold deionized water.

The third step is to plate with a layer of copper. Copper is coated to provide about 4 to 7% and preferably about 6% of the final weight of the coin. The gauge of the coating on each surface will be about 20–30 microns.

We prefer to use an acid bath for applying the copper. Although energy efficiency is better with a cyanide bath, higher current density can be used with an acid bath which gives a saving in time which more than offsets the lower energy efficiency. Also cyanide baths are hazardous to use and disposing of the waste may create environmental problems, if done improperly.

We have found that it is advantageous in applying the copper to commence at a low current of about 1/6 to ¼ of full power, and then increase to full power. This is important to minimize or avoid bridging with consequent blistering. The plating should therefore start at 1.2 to 1.8 amps per square foot for an initial period of about 15 to 20 minutes. Power is then increased to about 6 to 7 amps per square foot to complete the copper coating.

The copper coating should have a levelled finish to give a good foundation for the final coating. A limited amount of wetting agent and carrier and brightener may therefore be included in the electrolyte solution. Any of a variety of commercially available reagents may be used, most of which are of a proprietary nature and can only be identified by Trade designations. Examples of substances that may be used as wetting agent, carrier and brightener are Barrel CuBath B-76 leveler which may be used as brightener and Barrel CuBath B-76 Carrier, both supplied by Sel-Rex Oxy Metal Industries or Deca-Lume D-1-R, D-2-R and D-3-R supplied by M & T Chemicals. As previously noted, the wetting agent may be Y-17 supplied by M & T Chemicals.

Further information as to plating time for a given thickness may be derived on a theoretical basis using the following relationship:

| Element | Valence change | Electrochemical Equivalents g/f | mg/c | g/A.h |
|---|---|---|---|---|
| Copper | 1 | 63.55 | .6585 | 2.371 |
| | 2 | 31.78 | .3293 | 1.186 |
| Nickel | 2 | 29.36 | .3042 | 1.095 |

The following Example II will further illustrate the copper plating operations:

EXAMPLE II

Copper plating is carried out next. This is done by immersing and rotating the plating barrel in an acidic electroplating bath. The plating composition of the copper bath and the operating parameters are given in Table 2, as being typical:

TABLE 2

| | |
|---|---|
| Copper sulfate | 255 g/l |
| Copper (as metal) | 56 g/l |
| Sulfuric acid | 57 g/l |
| Choride ion | 70 ppm |
| pH = 1.0 | |
| Temperature = 24° C. | |
| Current density = 6–7 ASF | |
| Phosphorized copper anodes | |

This is a commercial proprietary electroplating system sold by Sel-Rex Oxy Metal Industries. The company recommends that the CuBath B-76 replenisher blend be added on an Ahr basis, at the rate of 1 cc/Ahr. It contains a ratio of 8:1 of carrier to leveler.

Other commercial acid copper plating systems are available and could have been used.

Our copper plating process differs from normal plating practices in the fact that the plating is initiated at a low current density, e.g., at 1/5 the full current density for about 15 minutes (1.2 to 1.4 ASF). After that short time, full current density is applied to the load, for approximately 4 hours to build a coating of approximately 6% by weight (See Table 5).

As illustrated in FIG. 1, the low current density at the beginning allows the copper coating to follow the contour of the micropores of the steel or nickel undercoating. This avoids bridging of the micropores which, in turn, causes tiny blisters to develop later on upon annealing. In FIG. 1 the diagonally hatched steel core is identified as 10, the nickel strike 11 is vertically hatched and the copper molecular layer 12 built up at initiation is stippled.

The initial thin, electrodeposited film thereby minimizes crevices, pits and scratches and helps to level the plating surface.

Our work has shown that when the initial low current density step is omitted, there is a great tendency for small blistering to occur.

In addition, the acid copper plating solution contains wetting agents and levelers whose performances are promoted and enhanced by the very slow plating cycle.

If full current density is applied at the beginning, as illustrated in FIG. 2, the edge of the micropore would have higher current intensity which favors quick build-up at the edge. Eventually, the pore is closed at the top and a site for blistering has been formed above the microcavity of the pore. This blistering may be caused by hydrogen or solution entrapment and made more significant upon annealing. In FIG. 2(*a*) (which shows core 10*a* and nickel strike 11*a* similar to 10 and 11 of FIG. 1) we have diagrammatically illustrated how the high current density at the start of plating promotes dendritic growth of the copper 12*a* at the edge of the pore. FIG. 2(*b*) shows the final stage where bridging occurs due to the copper plating 12*b* depositing faster at the edge of the pore to cause bridging.

Typically, for a load of 5 cents size blanks, the time for a 6% copper deposit is approximately 4 hours and the copper layer deposit is about 0.034 mm (see Table 5).

The plated barrel is then rinsed in a cold drag-out water tank, It is further rinsed with hot water, and finally, it is rinsed with cold deionized water for about 30 seconds.

Some 'pumping action' is created when cold water rinsing follows the hot water rinse. The dimensional contraction change at the microstructure level helps remove the plating solution from the pore to prevent staining and spotting out.

Proper control of the amount of brightener, carrier or leveler, and wetting agent is important as is known to those skilled in the art. The bath is initially charged with 40 ml of the 8:1 replenisher blend, such as the CuBath B-76 previously referred to, per gallon of plating electrolyte. Replenishment of the additives at a rate of ½ cc per ampere hour maintains the additives included in the replenisher blend such as levelers, stress reducers, grain refiners and carrier agents in balance, and at the proper levels in the bath.

We can now proceed to the final nickel plating or we may interrupt the plating sequence with an intermediate annealing step. This is done to relieve plating stress in the relatively thick copper coating, to remove entrapped hydrogen, and to remove surface organic components which are additives in the copper electroplating bath and which may cause blistering in subsequent nickel plating. It refines the grain structure prior to the coining procedure. It also tends to close micropores.

If the copper coated blank is to be annealed, annealing should be in a reducing atmosphere such as hydrogen so as to inhibit or even reduce oxidation. Annealing should be at a temperature of 500° C.-600° C. It has previously been the practice to heat to a higher temperature to try to fuse the nickel with the steel. These higher temperatures should be avoided as blistering may result. The annealed copper plated blank should have a hardness of about 35 to 40 R30T.

This extra intermediate annealing step serves many purposes. First, it removes hydrogen entrapped in the copper and nickel plated layers. Since the copper layer deposit if fairly thick, any hydrogen entrapped during plating ought to be removed before further plating. Secondly, the copper deposit is also highly stressed and the thermal treatment will help relax and remove the stress to prevent cracking due to the severe deformation upon minting. It is well known that annealing also modifies the grain structure of copper and makes it more ductile in cold work. Finally, it removes the organics on the surface of the copper and improves the bonding between copper and nickel, and helps to eliminate blistering. The organic material in the copper plating solution was needed to ensure good coverage and reduced pitting during copper plating. However, at the end of the copper plating those organics have outlived their usefulness and ought to be removed before nickel plating. The coining material thus obtained has proven to be blister free.

As an alternative, annealing at a temperature between 200° C. and 400° C. in the presence of a reducing atmosphere followed by annealing at a temperature of at least 530° C. may follow the application of the finishing coat of nickel.

The next step is to provide a finishing coat of nickel. This coating should be 1 to 1½% by weight of the coin or about 4 to 8 microns increase in gauge thickness on each surface. In the electroplating process a brightener is preferably included to give a smooth, bright final coating. Once again, the nickel is initially coated at a low current density of about 0.5 to 0.7 amps per square foot, which is about 1/6 to ¼ of the full current density. The low current density is used for an initial time of 15 to 20 minutes followed by 100 to 120 minutes at full current density of 3–4 amps per square foot. It is believed that this procedure of using a low current density, together with the initial low temperature annealing previously described, contributes to good adhesion of the plated layer to its substrate and also contributes to minimizing or avoiding bridging for the reasons previously explained. The nickel coated blank has a hardness of about 45 to 50 R30T.

The conditions under which the nickel plating layer is applied are exemplified by Example III.

EXAMPLE III

If we chose to proceed immediately with the outside nickel plating layer, we would first immerse and rotate the plating barrel in a 10% solution of sulfuric acid at room temperature for 30 seconds, then place the plating barrel into the final sulfamate nickel bath.

The composition of the nickel bath and the operating parameters are given in Table 3.

TABLE 3

| | |
|---|---|
| Nickel sulfamate | 77 g/l |
| Nickel chloride | 6 g/l |
| Boric acid | 37.5 g/l |

TABLE 3-continued

| |
|---|
| pH = 3.8 |
| Temperature = 50° C. |
| Current density = 3-4 ASF |

This is a commercial nickel electroplating system supplied by M & T Chemicals.

An antipit agent Y-17, also supplied by M & T Chemicals may be added as required, at 0.15% by volume. A leveller or brightener, commercially available, may be added to obtain different degrees of brightness. We find it satisfactory to add 0.125 ml of Niproteq W brightener per Ahr and 0.03 ml of Niproteq carrier per Ahr. Other commercially available brighteners and carriers may be used.

Again, it is important that we start off the final nickel process at a low current density at 1/5 the full current density for about 15 minutes (0.6 to 0.8 ASF) before taking the electroplating solution to full power at 3-4 ASF, for 2 hours to build a coating of approximately 1.5% by weight.

This 2-step nickel plating process follows the same reasoning as for the copper plating. Again, we have found that this stepping current density is very important in minimizing or eliminating blisters.

The plating barrel is then rinsed in a cold water dragout tank. It is further rinsed with hot water and finally with deionized water containing isopropyl alcohol.

Typically, for a load of 5 cents size blanks, the time for a 1½% nickel topcoat is approximately two hours and the nickel layer deposit is about 0.008 mm (see Table 5).

If the blanks have not been treated by annealing as an intermediate step between the application of the coating of copper and nickel, then the blanks are finally annealed in the presence of a reducing atmosphere at a moderate temperature between 200° C. to 400° C. for 40 minutes immediately followed by annealing at a minimum temperature of 530° C. for 20 minutes. The low temperature annealing promotes the removal of entrapped hydrogen, while the higher temperature annealing removes the final plating stress, changes the grain structure of the plated copper, and promotes some bonding between the copper and the nickel. Finally, the plated blanks are cleaned and minted or coined, that is to say, pressed in coining dies under impact force of the order of 170,000 to 200,000 p.s.i. to impart a suitable design to the surfaces and to shape the edges to provide a rim and sometimes a serrated edge.

A very large proportion of coins made in accordance with this invention are free from defects and remain free even under normal conditions of use such as exposure to salt water or acidic perspiration during handling.

The procedures previously described were used in the following Examples IV and V.

EXAMPLE IV

TABLE 4

| | Blank Diameter MM | Gauge MM | Current Density ASF | Time Min |
|---|---|---|---|---|
| EXAMPLE IV(a) 5 CENTS SIZE | | | | |
| Steel | 20.920 | 1.376 | | |
| 1% Nickel Strike | 20.938 | 1.392 | 8 | 28 |
| 6% Copper | 21.008 | 1.431 | 1.2 | 15 |
| | | | 6-7 | 240 |
| 1½% Nickel | 21.030 | 1.445 | 0.6 | 15 |
| | | | 3-4 | 129 |

TABLE 4-continued

| | Blank Diameter MM | Gauge MM | Current Density ASF | Time Min |
|---|---|---|---|---|
| EXAMPLE IV(b) 10 CENTS SIZE | | | | |
| Steel | 17.530 | 0.960 | | |
| 1% Nickel Strike | 17.548 | 0.976 | 8 | 20 |
| 6% Copper | 17.608 | 1.015 | 1.2 | 15 |
| | | | 6-7 | 210 |
| 1½ Nickel | 17.620 | 1.020 | 0.6 | 15 |
| | | | 3-4 | 102 |
| EXAMPLE IV(c) 25 CENTS SIZE | | | | |
| Steel | 23.499 | 1.224 | | |
| 1% Nickel Strike | 23.508 | 2.240 | 8 | 28 |
| 6% Copper | 23.573 | 1.279 | 1.2 | 15 |
| | | | 6-7 | 225 |
| 1½% Nickel | 23.589 | 2.288 | 0.6 | 15 |
| | | | 3-4 | 122 |

EXAMPLE V

TABLE 5

| Typical load = 100 blanks | | | | | |
|---|---|---|---|---|---|
| Thickness (mm) | Plating time for 1% at 8 AST Nickel Strike | Thickness (mm) | Plating time for 6% Copper | Thickness (mm) | Plating time for 1.5% Nickel |
| EXAMPLE V(a) 5 CENTS SIZE | | | | | |
| 0.005 | 28 min | 0.038 | 3 hr 48 min* | 0.0084 | 2 hr 9 min* |
| EXAMPLE V(b) 10 CENTS SIZE | | | | | |
| 0.0036 | 20 min | 0.030 | 3 hr* | 0.0069 | 1 hr 42 min* |
| EXAMPLE V(c) 25 CENTS SIZE | | | | | |
| 0.0048 | 28 min | 0.037 | 3 hr 42 min* | 0.0082 | 2 hr. 58 min |

All time values have been arithmetically calculated. Thickness is given as an overall average value.

*Note: Plating time for the 2 levels of current density has been lumped together.

Comparative tests have been conducted on struck tokens prepared using the process of this invention identified as "Ni-Cu-Ni coated" and a commercially available nickel coated struck token marketed by Sherritt Gordon Mines Limited and believed to be made in accordance with Canadian Patents 1,105,210 dated Jul. 21, 1981, and 1,198,073 dated Dec. 27, 1985, identified as "nickel coated".

1. HUMIDITY CHAMBER TEST

Struck tokens were dipped in artificial sweat solution, all excess moisture was removed from the token surface and the tokens were left 72 hours in the humidity chamber at 95% relative humidity, at room temperature. In the rating system used, 1 is good, 5 is poor, as indicated in detail in Table 6 which follows.

TABLE 6

| NUMBER RATING CORRESPONDING TO DEGREE OF SURFACE CORROSION | |
|---|---|
| NUMBER RATING | DEGREE OF CORROSION |
| 1 | None |
| 2 | Minimal (slight haze) |
| 3 | Mild (some cloudiness, yellowing; pre-corrosion stage) |
| 4 | Moderate (large degree of clouding and/or brownish spots) |
| 5 | Severe (distinct brown, red or black spots) |

The results obtained are given in Table 7.

TABLE 7

| Denomination | Ni—Cu—Ni coated | Nickel coated |
|---|---|---|
| 5 cent size | 90 rated at 1 | 75 rated at 1 |

TABLE 7-continued

| Denomination | Ni—Cu—Ni coated | Nickel coated |
|---|---|---|
| | 5 rated at 2 | 20 rated at 2 |
| | 5 rated at 3 | 5 rated at 3 |
| 10 cent size | 95 rated at 1 | 80 rated at 1 |
| | 2.5 rated at 2 | 10 rated at 2 |
| | 2.5 rated at 3 | 5 rated at 3 |
| | | 5 rated at 4 |
| 25 cent size | 95 rated at 1 | 90 rated at 1 |
| | 5 rated at 2 | 10 rated at 2 |

CORROSION PIT TEST

Struck tokens were immersed in 2% NaCl for 4 hours, with the tokens being turned over after 2 hours in solution. We should note that no rust appears on the Ni-Cu-Ni system.

The results are given in Table 8.

TABLE 8

| Denomination | Ni—Cu—Ni coated % | Nickel coated |
|---|---|---|
| 5 cent size | 80 rated at 1 | 90 rated at 1 |
| | 18 rated at 2 | 10 rated at 4 |
| | 2 rated at 3 | |
| 10 cent size | 84 rated at 1 | 85 rated at 1 |
| | 14 rated at 2 | 15 rated at 4 |
| | 2 rated at 3 | |
| 25 cent size | 82 rated at 1 | 75 rated at 1 |
| | 13 rated at 2 | 5 rated at 3 |
| | 5 rated at 3 | 20 rated at 4 |

At no time, did we see any orange color or red rust spot on the Ni-Cu-Ni token. The rating 3 indicates some yellowish stain at the rim. On the other hand, reddish black or orange black spots could be seen on the nickel coated token, particularly around the rim.

3. WEAR AND TEAR TEST

Standard wear and tear tests were done on the tokens for a period of 8 hours. Visual observations of the coins were made at the end of the test period. The results are shown in Table 9.

The Ni-Cu-Ni coated token offers much greater resistance to wear than the nickel coated token. Since the Ni-Cu-Ni surface is less damaged, the coins appear brighter while the nickel coated coins appear dull.

TABLE 9

| | Ni—Cu—Ni coated | | Nickel coated | |
|---|---|---|---|---|
| Denomination | *Average hardness R30T | Wear Rating | Average hardness R30T | Wear Rating |
| 5 cent size | 54.87 | 1 | 58.85 | 3 |
| 10 cent size | 46.45 | 1 | 48.09 | 3 |
| 25 cent size | 50.98 | 1 | 56.48 | 3 |

*Blanks were not annealed before coining

It is important to note that, the coins with the Ni-Cu-Ni system of this invention are about 10 percent lower in hardness than the nickel coated coins that were tested, yet its wear resistance is far superior. Therefore, it is expected that in circulation the Ni-Cu-Ni coated coin will resist far better the abuse than the commercially available nickel coated coin.

The theoretical explanation for this superior characteristic is that the monolayer of nickel in the nickel coated coin has a single metallic grain structure which is dendritic, and is more prone to denting than the multilayer composition of Ni-Cu -Ni coated coin whereby the grain structures and sizes of the different layers are dissimilar and therefore offer more resistance to penetration caused by abuse, wear and tear.

Advantages of the invention additional to those apparent from the comparative tests outlined above include:

a) Blanks made of a low carbon steel core and plated with nickel, copper and nickel successively, by commercially available plating solutions produce white finish coins, which offer excellent visual appearance, and excellent resistance against tarnishing and corrosion.

b) This system produces a coin which has excellent wear and tear resistance when compared to high grade nickel (99% plus), cupro nickel, 430 stainless steel, and other commercially plated nickel or laminated nickel coins. This is due to the nature of the multilayer undercoating.

c) The coins produced by this method typically have an underlayer of 0.8% to 1.5% nickel, an intermediate layer of 4% to 7% copper and a top layer of 1% to 2% nickel. There is therefore a saving of the cost of material. The Ni-Cu-Ni system costs about 60-66% of the material cost of the nickel coated coins tested.

d) This system offers better corrosion and pitting corrosion resistance than a single layer of metal.

e) This system is flexible since one may stop at the copper layer to produce a copper color coin or one may proceed further with the nickel topcoat to produce a white color coin.

f) The all acid plating solutions are fully compatible and eliminate the dangerous mix of acidic nickel plating and cyanide base copper plating. The Ni-Cu-Ni system is environmentally more friendly than the cyanide system often used. The preferred acid copper plating can be easily neutralized and discarded. A cyanide based bath requires decomposition of the cyanide to a less dangerous form before discharging into a regular waste water treatment facility.

g) A 2-step current density plating operation is applied during the copper phase plating and the final nickel phase plating. A very low density, i.e. 1/5 of the full current density, is applied at the beginning of plating for a short period of time, say 15 to 30 minutes followed by a high current, i.e., full current density after the initiation period. This 2-step operation produces interlayer bondings which are excellent compared to the normal practice of plating at full current from the very start.

This practice promotes intermolecular bonding between dissimilar materials and thorough coating of the micropores. It also minimizes bridging and blistering as a consequence.

This initial slow plating provides an intimate and excellent physical bonding without high temperature thermal treatment which is sometimes used to induce metallurgical diffusion of metal for bonding purposes. This operation, thereby, gives rise to energy saving and may further reduce the overall processing time and cost for blank manufacturing by possibly eliminating the need for thermal treatment in some instances.

h) The heat treatment temperature used in this procedure for annealing is low and does not approach the temperature of phase changes or crystal structure change from body centered cubic ferrite to face centered cubic austenite. This explains the ability of this process to easily produce low hardness blanks at 40 R30T compared to other commercial processes which rely on high temperature, thermal diffusion, consequently high temperature gradient which makes it difficult to have blank hardness below 45-50 R30T on average.

i) The highly ductile and soft copper intermediate layer facilitates material flow during coining. Relatively lower force is required to mint coins resulting in definitely higher die life. Ni-Cu-Ni offers better flow characteristics during minting than Ni, thanks to the copper layer, which is much more ductile than the single nickel layer. In fact, laboratory tests have shown that the thicker the nickel coating, that is, the higher the percentage of nickel, the earlier scoring marks are seen on the dies, that is, the lower the die life is.

j) The thin nickel top layer, approximately 0.005 mm thick, is relatively more ductile than a nickel layer 6 to 8 times thicker, needed to provide good coverage and protection of the steel, when there is no copper underlayer. This fact, in turn, has proven to be beneficial in minimizing or eliminating a phenomenon known as 'starbursting' in coining. The thicker nickel layer has higher dendritic peaks which are quite abrasive. The abrasiveness of nickel scores the coining die surface and damages it. The thinner nickel layer on the other hand, has shorter dendritic peaks which are relatively less abrasive.

k) The Ni-Cu-Ni coating system is about twice as fast as the Ni coating system. To obtain a coating thickness of 1% nickel, 4-7% copper and 1-1.5% nickel. The laboratory plating time is from 5¼ to 6 hours excluding rinsing times while it took about 11-12 hours to obtain 6% plating of nickel.

l) The nature of the multilayer coating makes the whole system less active in terms of galvanic action and emf potential between the nickel and the steel. The results of tests have shown that the multilayer system is less prone to corrosion than the single nickel layer system.

m) The nickel-copper-nickel structure on steel is more economical to produce and offers better protection against corrosion than a nickel on steel structure because the thinner, more expensive nickel is only there to provide a white finish while the thicker, less expensive copper performs the protective function toward steel.

What is claimed is:

1. A process for making a coin blank or like articles comprising:

a) cleaning a ferrous metal blank so that it will be essentially free of oxide;

b) electroplating said blank with a strike of nickel;

c) electroplating the strike of nickel with a coating of copper by first depositing a thin, initial film of copper at a low current density in a bath that is about 1/6 to ¼ of the full current density and then depositing the remainder of the copper coating at a full current density in the same bath to minimize or avoid bridging of micropores in the ferrous metal blank.

2. A process as in claim 1, in which in cleaning the blank an acid pickle is used to remove oxides followed immediately by a buffer wash.

3. A process as in claim 1, in which the nickel used for the nickel strike is dull nickel.

4. A process as in claim 1, in which the copper is coated using a acid bath.

5. A process as in claim 1, in which the low current density at which the copper is coated is about 1.2 to 1.5 amps per square foot.

6. A process as in claim 1, in which the low current density at which the copper is coated is about 1.2 to 1.8 amps per square foot, and the full current density is about 6-7 amps per square foot.

7. A process as in claim 1, in which the nickel strike is about 0.8 to 1.2% of the final weight of the coin, and the coating of copper is about 4 to 7% of the final weight of the coin.

8. A process as in claim 1, in which following the application of the copper coating and prior to application of any outer nickel coating the coin blank is annealed at a temperature in the range 500° C.-600° C. in the presence of a reducing atmosphere.

9. A process for making a coin blank or like articles comprising:

a) cleaning a ferrous metal blank so that it will be essentially free of oxide;

b) electroplating said blank with a strike of nickel;

c) electroplating the strike of nickel with a coating of copper by first depositing a thin, initial film of copper at a low current density in a bath that is about 1/6 to ¼ of the full current density and then depositing the remainder of the copper coating at a full current density in the same bath to minimize or avoid bridging of micropores in the ferrous metal blank.

d) electroplating the copper with an outer layer of nickel by first depositing a thin, initial film of nickel at a low current density that is about 1/6 to ¼ of the full current density and then depositing the remainder of the nickel coating at a full current density to minimize or avoid bridging of micropores in the ferrous metal blank.

10. A process of making a coin as in claim 9 including the step of pressing the coated blank in a coining operation without the development of cracks or pores which would expose the ferrous metal.

11. A process as in claim 9, in which the low current density at which the outer layer of nickel is coated at about 0.5 to 0.7 amps per square foot.

12. A process as in claim 9, in which the low current density at which the outer layer of nickel is coated is about 0.5 to 0.7 amps per square foot, and the full current density at which the outer layer of nickel is coated is about 3-4 amps per square foot.

13. A process as in claim 9, in which the nickel strike is about 0.8 to 1.2% of the final weight of the coin, and the coating of copper is about 4 to 7% of the final weight of the coin, and the outer layer of nickel is about 1 to 1½ of the final weight of the coin.

14. A process as in claim 9, in which following the outer nickel coating the coin blank is annealed at a temperature in the range 200° C. to 400° C. in the presence of a reducing atmosphere to promote the removal of entrapped hydrogen followed by annealing at a temperature of at least 530° C. to remove stress, improve the grain structure of the copper and promote bonding between the copper and the nickel.

* * * * *